US012446675B1

(12) United States Patent
Murdock

(10) Patent No.: US 12,446,675 B1
(45) Date of Patent: Oct. 21, 2025

(54) LOTION APPLICATOR

(71) Applicant: Jean L. Murdock, London, AR (US)

(72) Inventor: Jean L. Murdock, London, AR (US)

( * ) Notice: Subject to any disclaimer, the term of this patent is extended or adjusted under 35 U.S.C. 154(b) by 364 days.

(21) Appl. No.: 18/097,276

(22) Filed: Jan. 15, 2023

(51) Int. Cl.
*A45D 34/04* (2006.01)

(52) U.S. Cl.
CPC ..... *A45D 34/042* (2013.01); *A45D 34/041* (2013.01); *A45D 2200/1081* (2013.01)

(58) Field of Classification Search
CPC .. A45D 34/042; A45D 34/041; A45D 40/261; A45D 40/262; A45D 2200/1081; A45D 2200/10; A45D 2200/1009
USPC ..... 401/6, 183–185; D28/7
See application file for complete search history.

(56) References Cited

U.S. PATENT DOCUMENTS

| | | | | |
|---|---|---|---|---|
| 4,150,904 | A * | 4/1979 | Stewart | B05C 17/0217 401/6 |
| 4,961,661 | A * | 10/1990 | Sutton | A45D 34/04 D28/7 |
| 6,261,014 | B1 | 7/2001 | Altobellis et al. | |
| 6,491,463 | B1 * | 12/2002 | Richard | A45D 34/04 401/136 |
| D518,597 | S | 4/2006 | Sommers | |
| 7,309,180 | B2 | 12/2007 | Russell et al. | |
| D572,407 | S | 7/2008 | Cook et al. | |
| D587,844 | S | 3/2009 | Slavin et al. | |
| D614,806 | S | 4/2010 | Arrington | |
| 8,875,337 | B2 | 11/2014 | Tacoma | |
| 8,967,898 | B1 * | 3/2015 | Dayeh | A47K 7/03 401/23 |
| 9,351,613 | B1 | 5/2016 | Tacoma | |
| D950,152 | S * | 4/2022 | Daniel | D28/7 |
| D1,032,084 | S * | 6/2024 | Murdock | D28/7 |
| 2006/0008313 | A1 * | 1/2006 | Wisniewski | A45D 34/042 401/6 |
| 2009/0092435 | A1 * | 4/2009 | Stevens | A45D 34/04 401/268 |

OTHER PUBLICATIONS

22' Super-Flex Body-Reach+ Bendable 'Unbreakable' Lotion Applicator Includes: (10) SpongeAbles or 2 year supply!. Product Listing [online]. © 1996-2023, Amazon.com, Inc. [retrieved on Jan. 12, 2023]. Retrieved from the Internet: <URL: https://www.amazon.com/Super-Flex-Body-Reach-Bendable-Unbreakable-Applicator/dp/B00VG0V6VA>.

* cited by examiner

*Primary Examiner* — David J Walczak
(74) *Attorney, Agent, or Firm* — Cramer Patent & Design

(57) ABSTRACT

The lotion applicator may comprise an applicator arm, a product reservoir, and an applicator head. The lotion applicator may be adapted for a user to apply a product to an area of skin. As non-limiting examples, the product may be a lotion, an ointment, a sunscreen, a topical pain reliever, or a moisturizer and the area of skin may be a user's back, a user's feet, or other hard-to-reach areas. The applicator arm may be an inverted J shape with the applicator head located at a distal end of the applicator arm. The product reservoir may be located at a proximal end of the applicator arm. The proximal end of the applicator arm and/or the product reservoir may be adapted to be held by the user such that the user may position the applicator head against the area of skin to apply the product.

2 Claims, 10 Drawing Sheets

LOTION APPLICATOR

RELATED APPLICATIONS

Non-applicable.

FIELD OF THE INVENTION

The present invention relates generally to a lotion applicator and more specifically to a lotion applicator having a J-shaped arm.

BACKGROUND OF THE INVENTION

Lotion applicators are commonly used to apply lotion to the skin, particularly to hard-to-reach areas. These applicators often include a handle and a head, with the head being used to apply the lotion. However, existing applicators in the prior art can be difficult to maneuver, especially when trying to reach certain areas of the skin.

The present device provides a lotion applicator with a unique J-shaped applicator arm design. The J-shaped applicator arm allows for easy maneuvering and precise application of lotion to hard-to-reach areas of the skin. The use of the lotion applicator addresses the aforementioned issue in the prior art in a manner that is effective and efficient.

SUMMARY OF THE INVENTION

To achieve the above and other objectives, the present invention provides for a lotion applicator comprising three main components: a J-shaped applicator arm, a product reservoir, and an applicator head. The J-shaped applicator arm allows for easy maneuvering and precise application of lotion to hard-to-reach areas of the skin. The user can bend and twist the applicator arm in various directions to reach those areas with ease. The product reservoir is designed to hold a sufficient amount of lotion for multiple uses and can be refilled as needed. The applicator head can be used to apply lotion to the skin and can be made in various shapes and materials (e.g., foam, felt, silicone) depending on the application. The applicator arm can also be connected to the applicator head via a swivel coupler, which allows for a change in the angle between the arm and head for different approach angles when applying the lotion. The product reservoir can be detached from the applicator arm and is refilled via an open top of the product reservoir. The product can be lotion, ointment, sunscreen, topical pain reliever, or moisturizer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
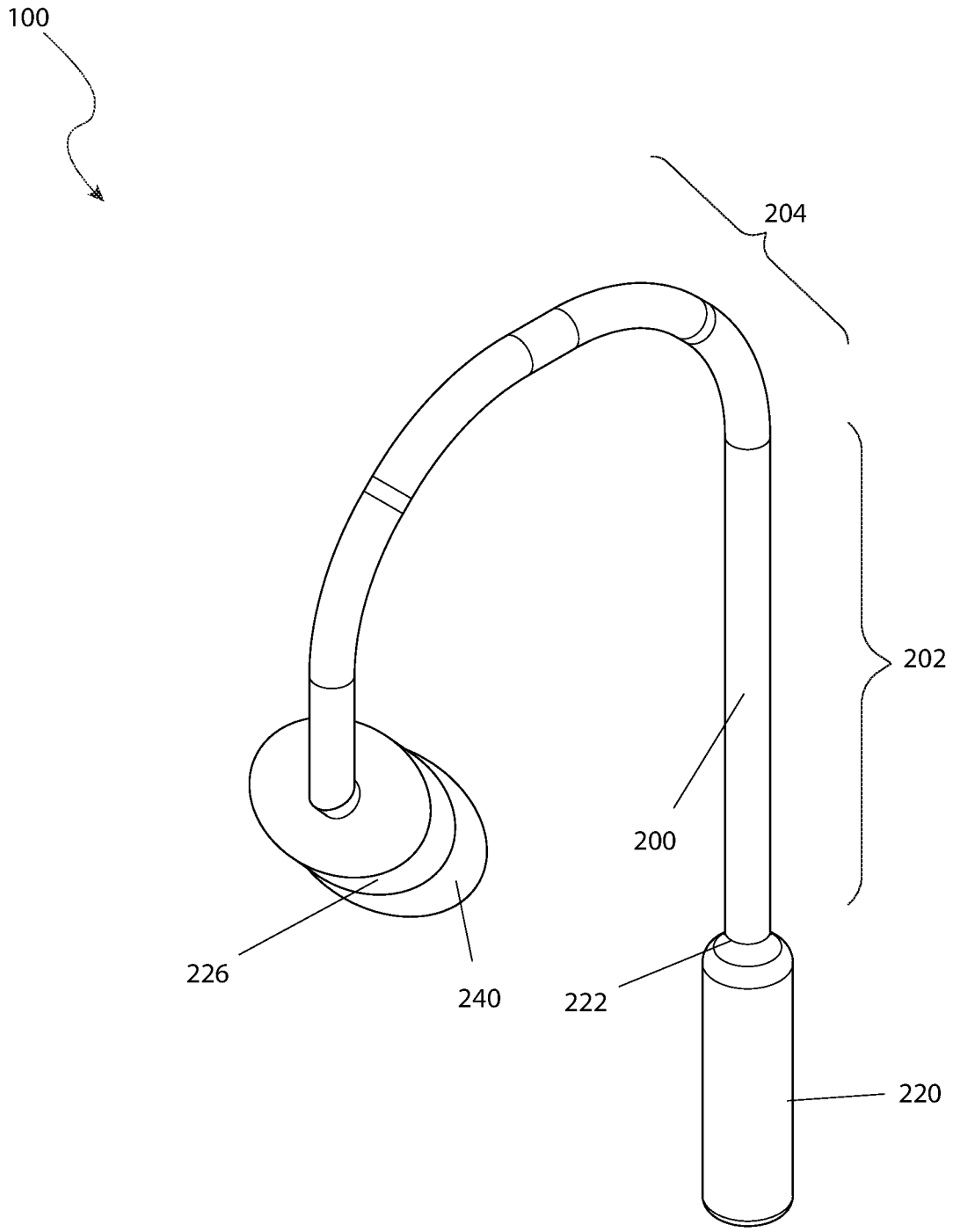
FIG. 1 is a front isometric view of a lotion applicator, according to an embodiment of the present invention.
Figure 2A:
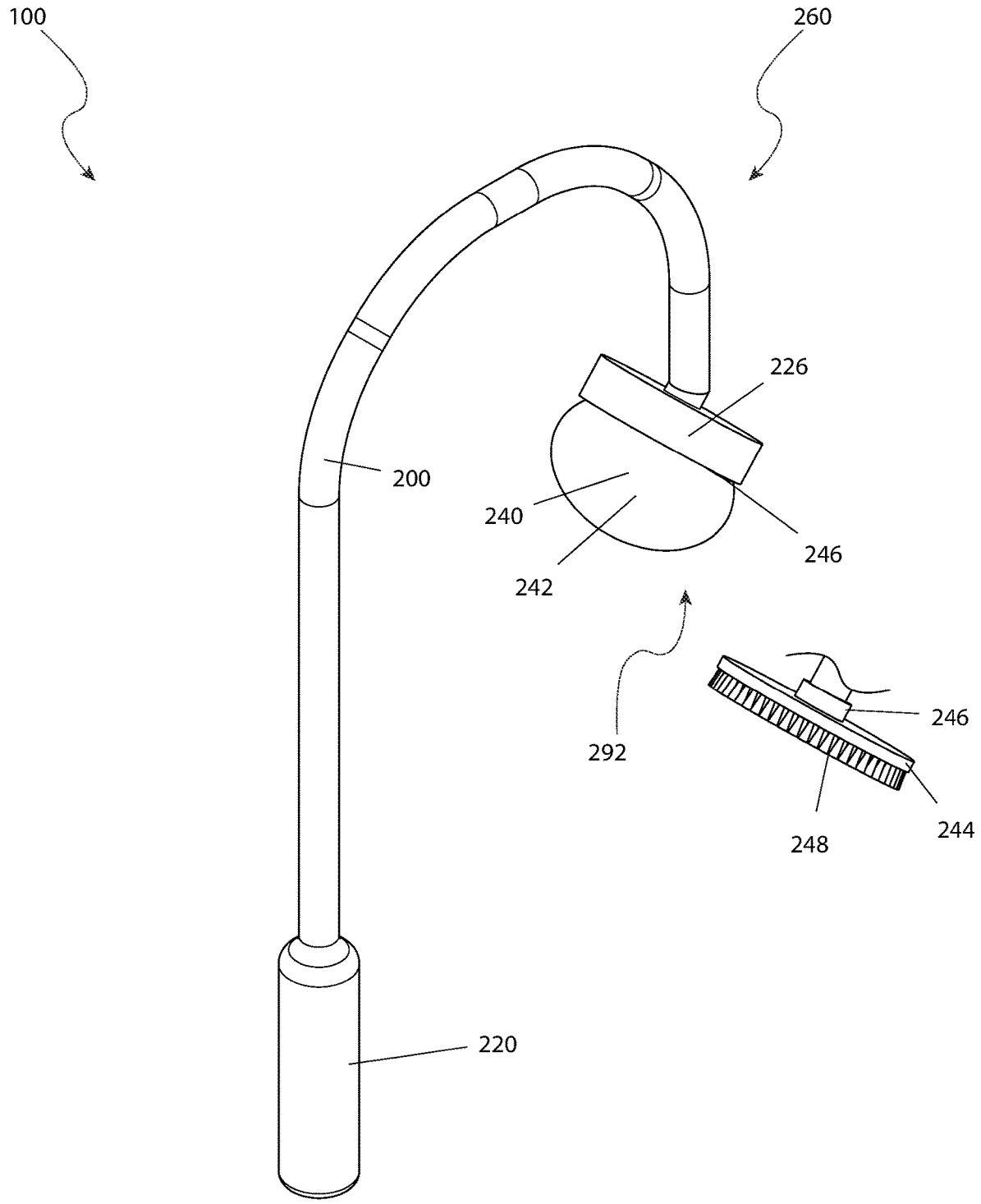
FIG. 2A is a rear isometric view of a lotion applicator of a first size, according to an embodiment of the present invention.
Figure 2B:
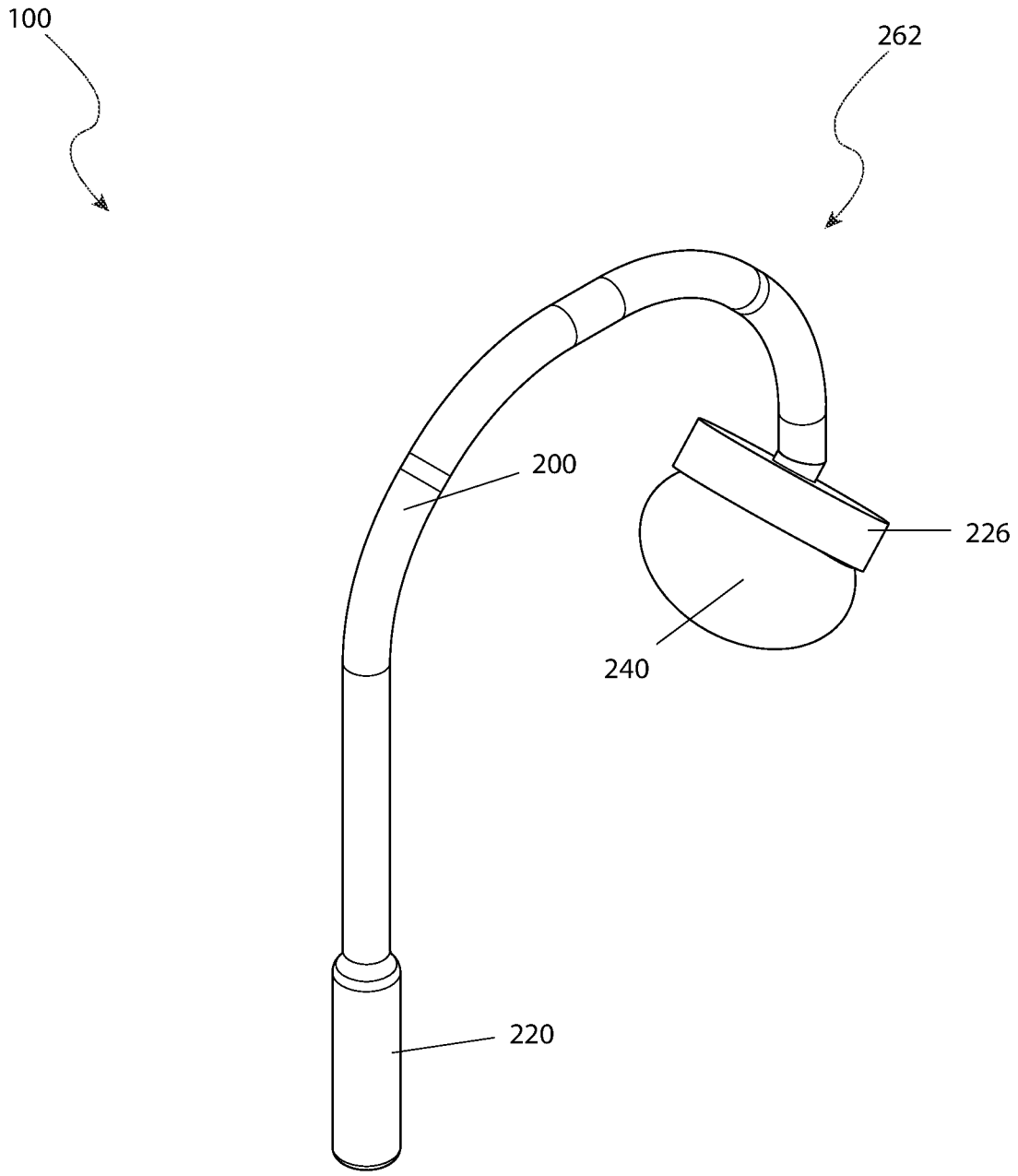
FIG. 2B is a rear isometric view of a lotion applicator of a second size, according to an embodiment of the present invention.
Figure 3A:
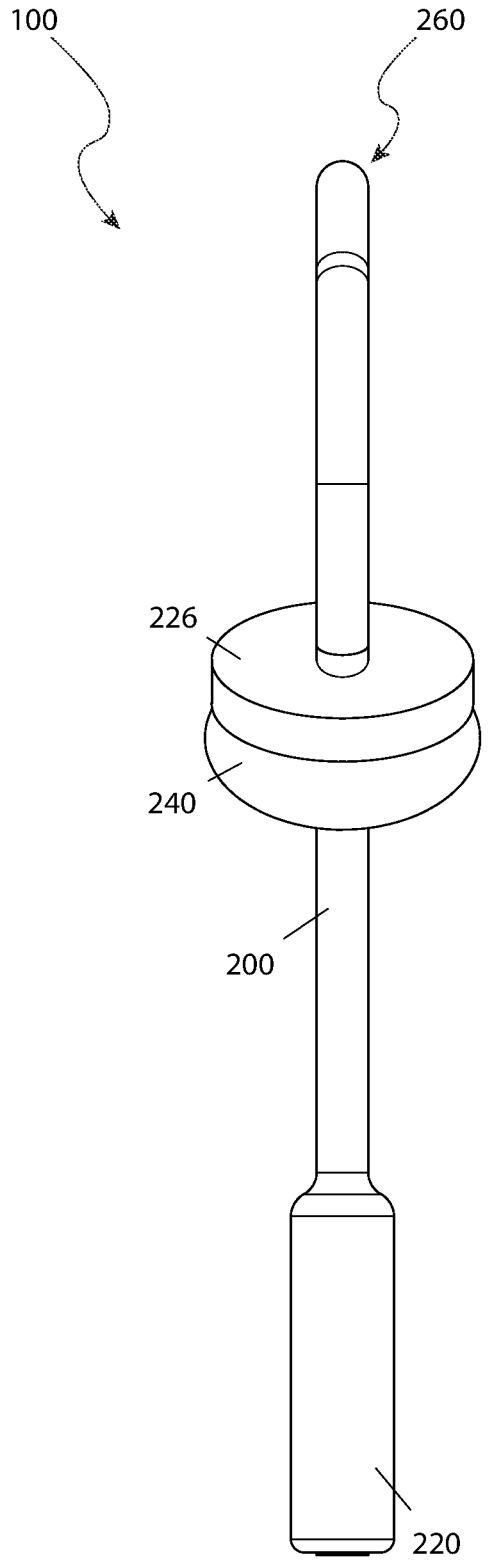
FIG. 3A is a front view of a lotion applicator of a first size, according to an embodiment of the present invention.
Figure 3B:
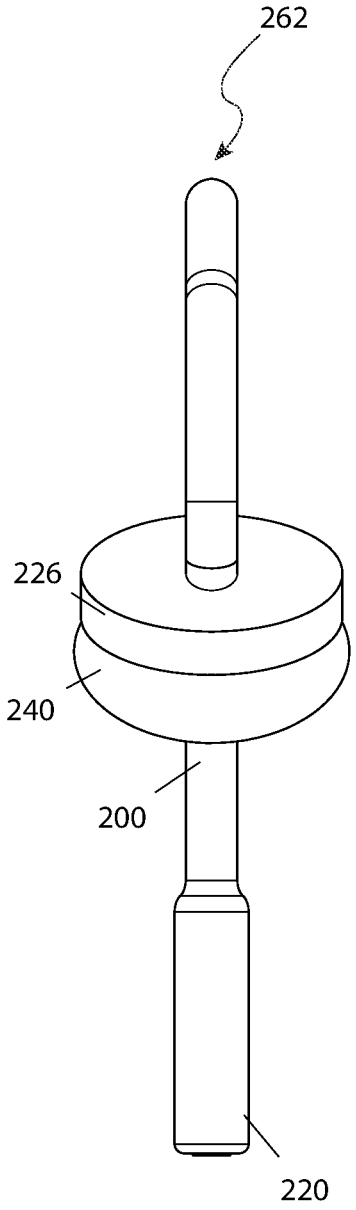
FIG. 3B is a front view of a lotion applicator of a second size, according to an embodiment of the present invention.
Figure 4A:
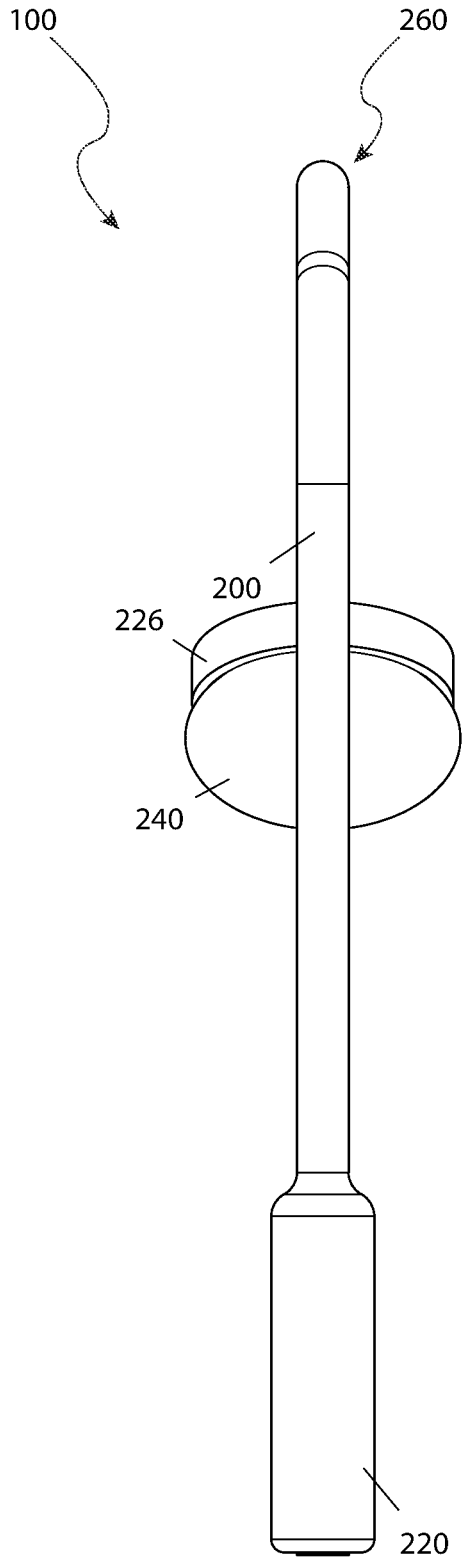
FIG. 4A is a rear view of a lotion applicator of a first size, according to an embodiment of the present invention.
Figure 4B:
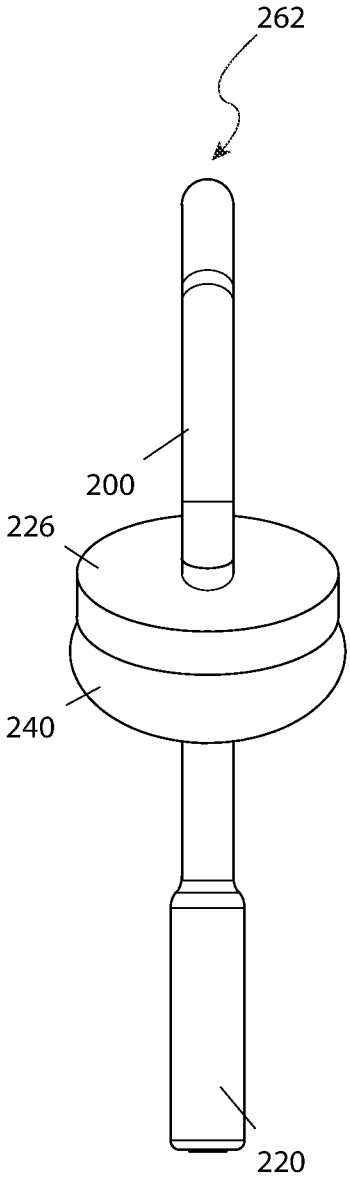
FIG. 4B is a rear view of a lotion applicator of a second size, according to an embodiment of the present invention.
Figure 5:
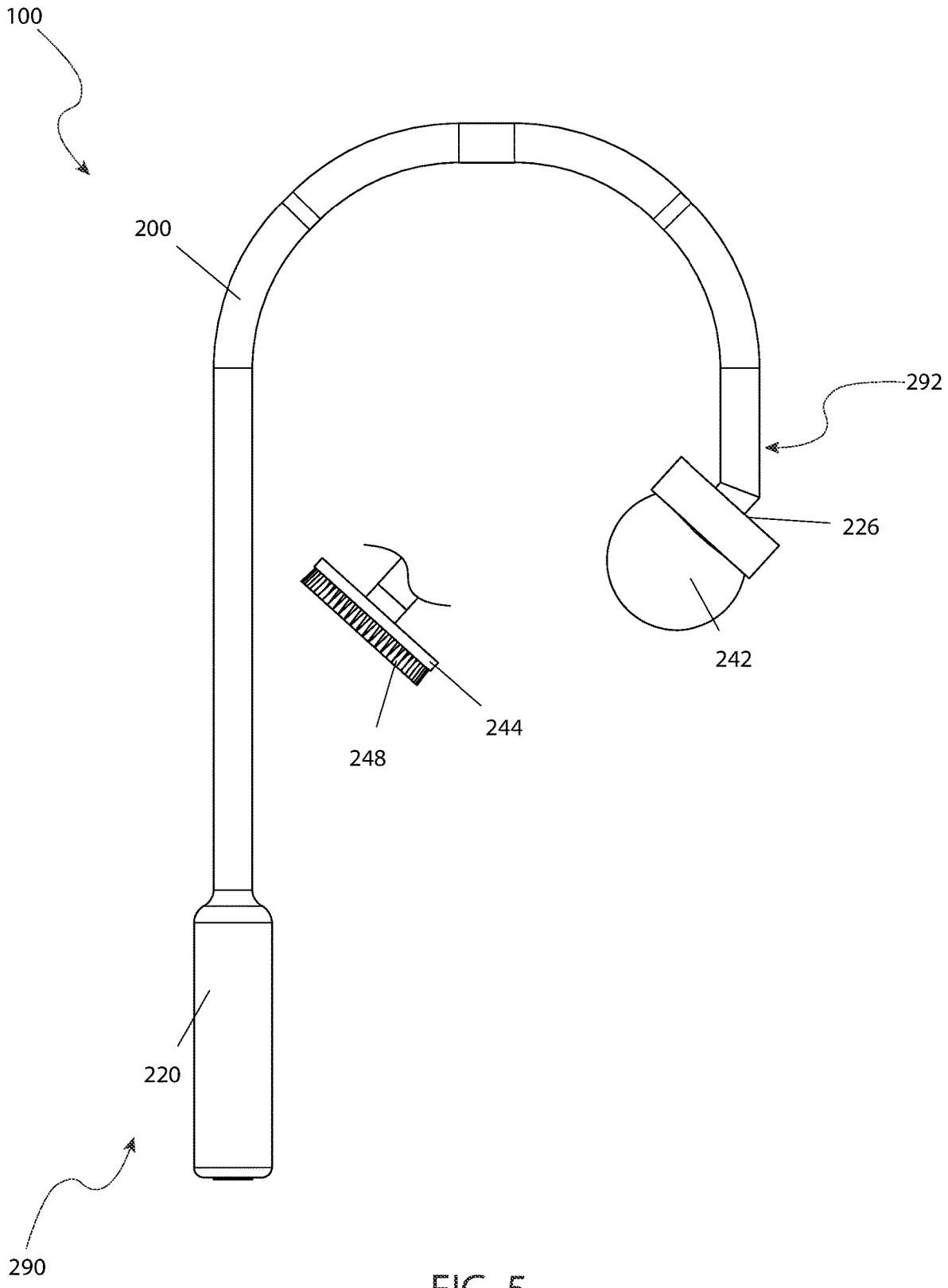
FIG. 5 is a left side view of a lotion applicator, according to an embodiment of the present invention.
Figure 6:
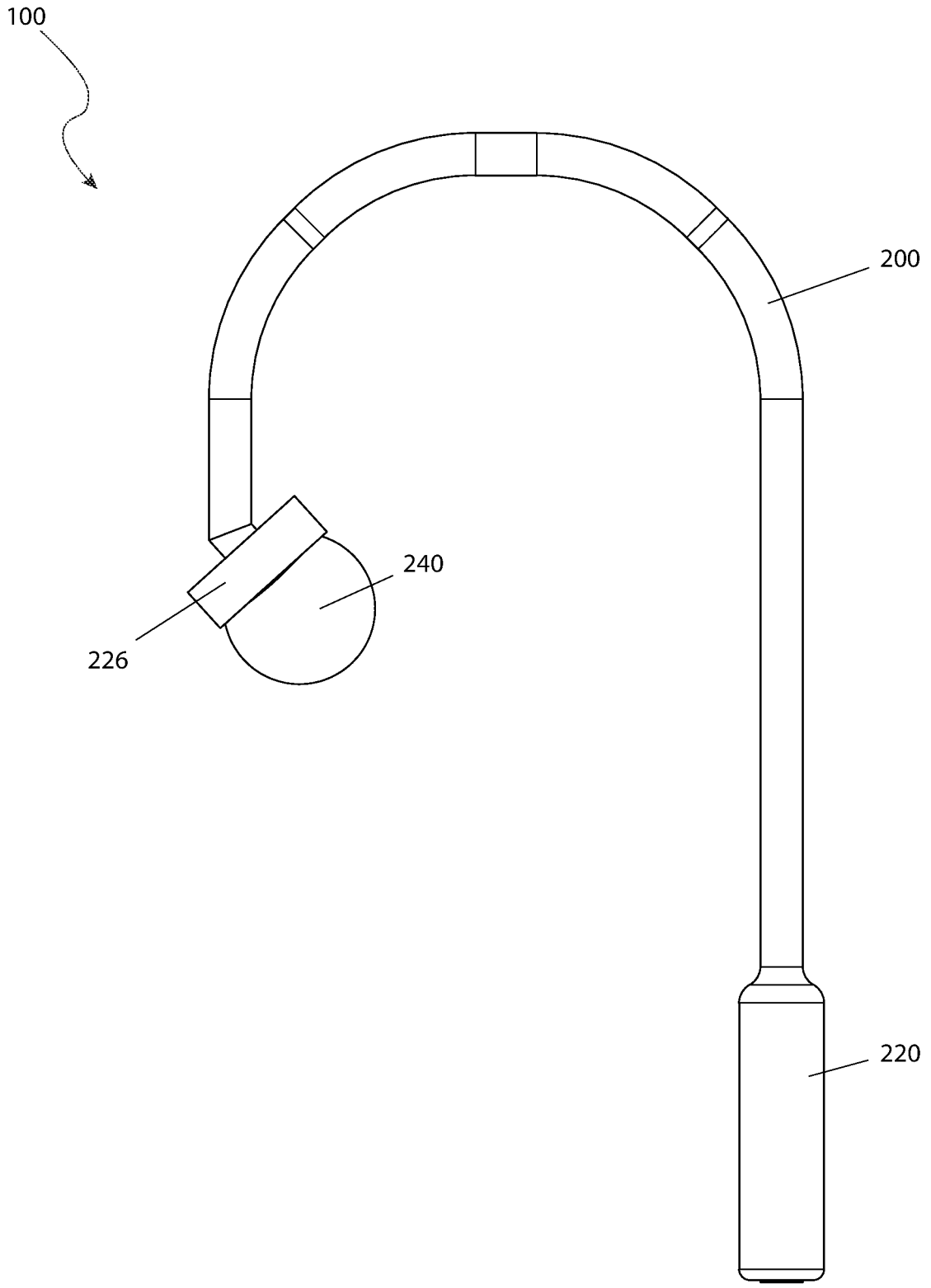
FIG. 6 is a right side view of a lotion applicator, according to an embodiment of the present invention.
Figure 7A:
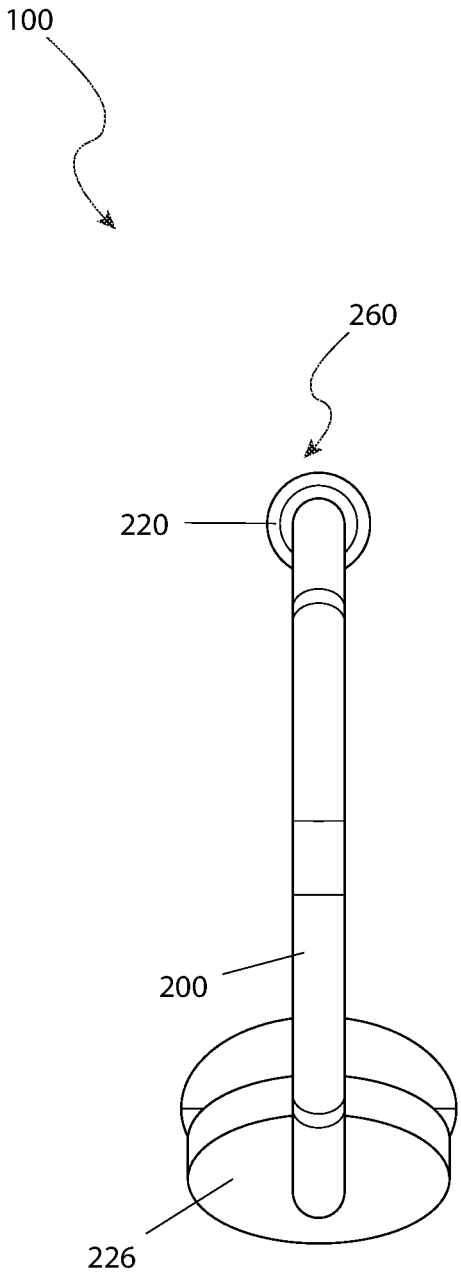
FIG. 7A is a top view of a lotion applicator of a first size, according to an embodiment of the present invention.
Figure 7B:
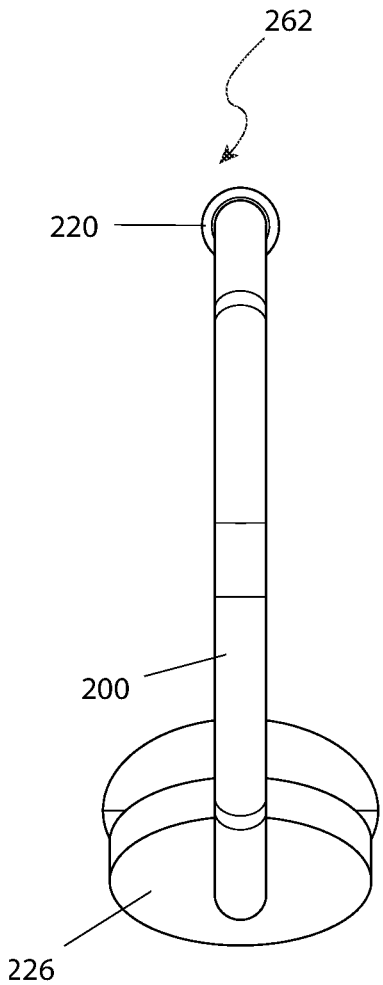
FIG. 7B is a top view of a lotion applicator of a second size, according to an embodiment of the present invention.
Figure 8A:
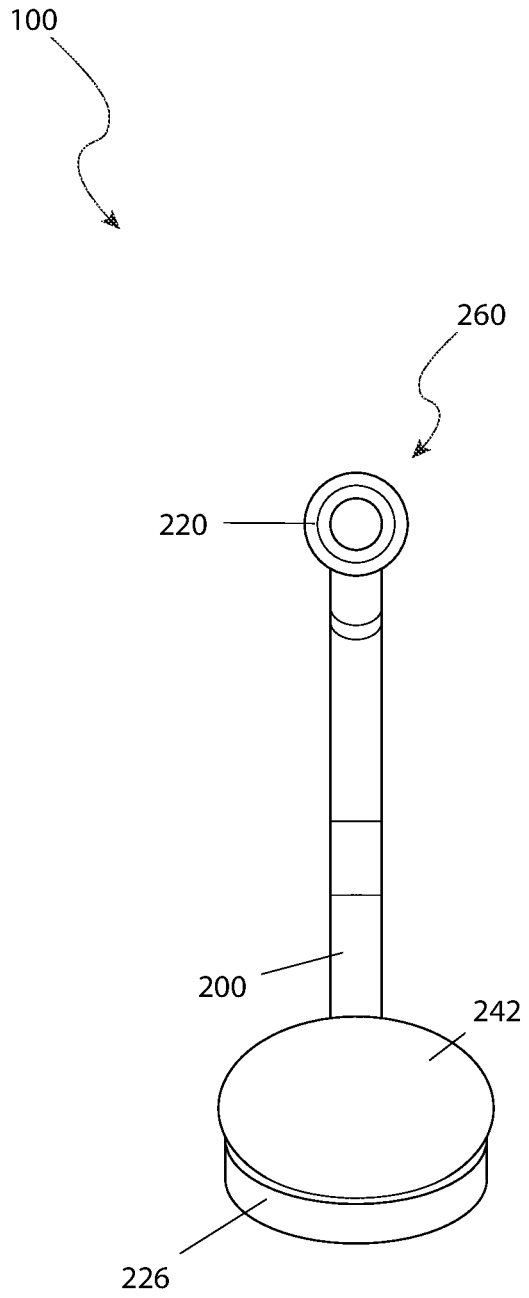
FIG. 8A is a bottom view of a lotion applicator of a first size, according to an embodiment of the present invention.
Figure 8B:
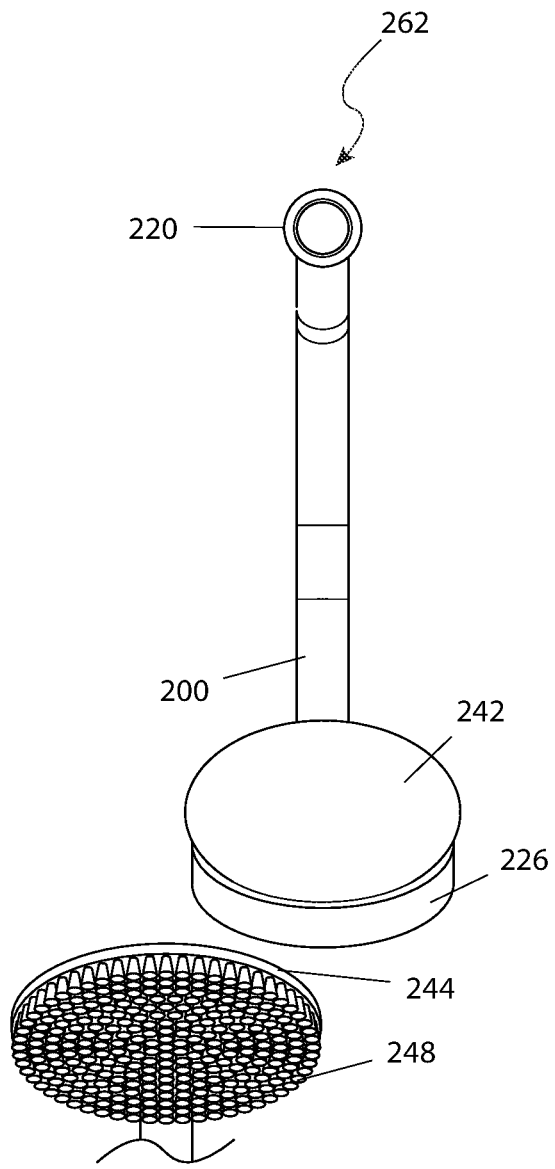
FIG. 8B is a bottom view of a lotion applicator of a second size, according to an embodiment of the present invention.
Figure 9:
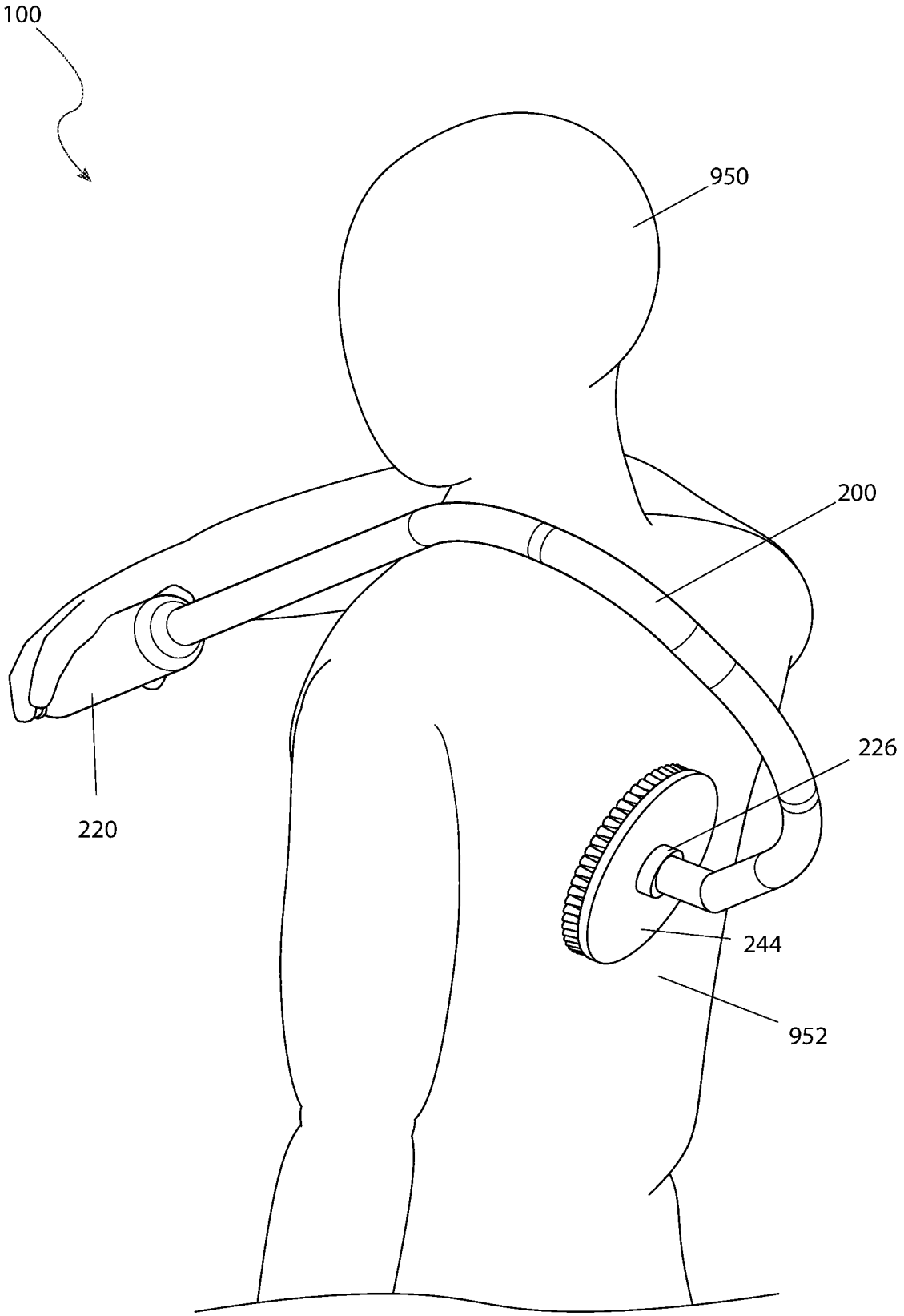
FIG. 9 is an in-use view of a lotion applicator, according to an embodiment of the present invention.

100 lotion applicator
200 applicator arm
202 straight portion
204 bent portion
220 product reservoir
222 open top
226 swivel coupler
240 applicator head
242 roller element
244 brush
246 applicator coupler
248 plurality of bristles
260 first size
262 second size
290 proximal end
292 distal end
950 user
952 user's back

DESCRIPTION OF THE INVENTION

The present invention is directed to a lotion applicator (herein described as the "invention") 100. The invention 100 may comprise an applicator arm 200, a product reservoir 220, and an applicator head 240. The invention 100 may be adapted for a user 950 to apply a product to an area of skin. As non-limiting examples, the product may be a lotion, an ointment, a sunscreen, a topical pain reliever, or a moisturizer and the area of skin may be a user's back 952, a user's feet, or other hard-to-reach areas. The applicator arm 200 may be an inverted J shape with the applicator head 240 located at a distal end 292 of the applicator arm 200. The product reservoir 220 may be located at a proximal end 290 of the applicator arm 200. The proximal end 290 of the applicator arm 200 and/or the product reservoir 220 may be adapted to be held by the user 950 such that the user 950 may position the applicator head 240 against the area of skin to apply the product.

The applicator arm 200 may be a J-shaped armature comprising a straight portion 202 and a bent portion 204. The straight portion 202 and the bent portion 204 may meet at a midpoint of the applicator arm 200. The free end of the straight portion 202 may define the proximal end 290 of the applicator arm 200 and the free end of the bent portion 204 may define the distal end 292 of the applicator arm 200. The bent portion 204 of the applicator arm 200 may bend by one hundred eighty degrees with an error of twenty degrees (180°+/−20)°. The bent portion 204 may be adapted to position the applicator head 240 on the opposite side of the user 950 from where the applicator arm 200 is being held.

The product reservoir 220 may be a hollow container for storing the product before the product is dispensed. The product reservoir 220 may detachably couple to the distal end 292 of the applicator arm 200. The product reservoir 220 may be refilled via an open top 222 of the product reservoir 220 while the product reservoir 220 is decoupled from the applicator arm 200.

The product reservoir 220 may be adapted to be squeezed by the user 950. Squeezing the product reservoir 220 may force the product through the applicator arm 200 to the applicator head 240.

The applicator head 240 may be adapted to dispense the product onto the area of skin. The applicator head 240 may receive the product through an applicator coupler 246 and may distribute the product within the applicator head 240. The applicator head 240 may be adapted to contact the area of skin and to transfer the product onto the area of skin as the applicator head 240 is moved over the surface of the area of skin.

As non-limiting examples, the applicator head 240 may be adapted to transfer the product onto the area of skin via a roller element 242, a brush 244, a roller cylinder, a sponge, or any combination thereof. The roller element 242 and applicator head 240 may be an ovoid shape that may be adapted to rotate as the roller element 242 is moved along the area of skin. The rotation of the roller element 242 may be adapted to simultaneously apply the product to the area of skin on one (1) side of the roller element 242 and apply the product to the roller element 242 on the opposite side of the roller element 242. The brush 244 may be adapted to dispense the product onto the area of skin and to work the product into the area of skin using a plurality of bristles 248. The brush 244 may also have a generally ovoid shape.

In some embodiments, the coupling between the applicator arm 200 and the applicator head 240 may comprise a swivel coupler 226. The swivel coupler 226 may be operable to change the angle between the applicator arm 200 and the applicator head 240 such that the approach angle of the applicator head 240 to the area of skin may be changed.

In some embodiments, the invention 100 may be available in multiple sizes. As non-limiting examples, the invention 100 may be available in a first size 260 adapted for use by adults and in a second size 262 adapter for use by children where the second size 262 is smaller than the first size 260. Alternatively, the invention 100 may be available in a first size 260 adapted for use by men and in a second size 262 adapter for use by women where the second size 262 is smaller than the first size 260.

As non-limiting examples, the applicator arm 200 of the second size 262 may be shorter, the product reservoir 220 of the second size 262 may be smaller, or both.

In use, the product may be placed into the product reservoir 220 and the product reservoir 220 may be coupled to the proximal end 290 of the applicator arm 200. To apply the product to the user's back 952 the user 950 may grasp the product reservoir 220 and hold the product reservoir 220 in front of their chest with the bent portion 204 of the applicator arm 200 extending over the shoulder and behind the user's back 952. This may position the applicator head 240 adjacent to the user's back 952. The user 950 may squeeze the product reservoir 220 to dispense the product. The user 950 may then move the product reservoir 220 up, down, left, and right while pressing the applicator head 240 against the user's back 952.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A lotion applicator, comprising:

an applicator arm having a proximal end and a distal end, the applicator arm formed in an inverted J-shape and comprising a straight portion and a bent portion meeting at a midpoint of the applicator arm, the proximal end defined by a free end of the straight portion and the distal end defined by a free end of the bent portion, wherein the bent portion forms a bend of approximately one hundred eighty degrees with a tolerance of plus or minus twenty degrees, and is adapted to position an applicator head on a side of a user opposite a side where the applicator arm is held;

a product reservoir disposed at the proximal end of the applicator arm, the product reservoir comprising a hollow container configured to be grasped and squeezed by a user to force a product through the applicator arm toward the distal end, the product reservoir further comprising an open top and being detachably couplable to the proximal end of the applicator arm for refilling; and, an applicator head coupled to the distal end of the applicator arm via a swivel coupler, the applicator head configured to contact an area of skin and to receive the product through an applicator coupler, the swivel coupler being operable to change an angle between the applicator arm and the applicator head such that an approach angle of the applicator head to the area of skin is adjustable; and, wherein the applicator head comprises both a roller element and a brush element, the roller element being ovoid and rotatable to simultaneously receive and dispense the product, and the brush element comprising a plurality of bristles adapted to work the product into the skin.

2. The lotion applicator of claim 1, further comprising the product wherein the product is selected from the group consisting of a lotion, an ointment, a sunscreen, a topical pain reliever, or a moisturizer.

* * * * *